US010563915B2

(12) United States Patent
Mackillop

(10) Patent No.: US 10,563,915 B2
(45) Date of Patent: Feb. 18, 2020

(54) INSTRUMENT AIR SYSTEM AND METHOD

(71) Applicant: John Paul Mackillop, High River (CA)

(72) Inventor: John Paul Mackillop, High River (CA)

( * ) Notice: Subject to any disclaimer, the term of this patent is extended or adjusted under 35 U.S.C. 154(b) by 332 days.

(21) Appl. No.: 15/477,397

(22) Filed: Apr. 3, 2017

(65) Prior Publication Data

US 2018/0283776 A1 Oct. 4, 2018

(51) Int. Cl.

| | |
|---|---|
| ***F25J 3/02*** | (2006.01) |
| ***F04B 37/10*** | (2006.01) |
| ***F04B 41/06*** | (2006.01) |
| ***F04B 39/06*** | (2006.01) |

(52) U.S. Cl.

CPC ..... *F25J 3/0295* (2013.01); *F04B 39/06* (2013.01); *F04B 41/06* (2013.01); *F25J 3/0209* (2013.01); *F04B 37/10* (2013.01); *F25J 2230/30* (2013.01); *F25J 2290/80* (2013.01); *F25J 2290/90* (2013.01)

(58) Field of Classification Search

CPC . F04B 37/10; F04B 39/06; F04B 41/06; F25J 2230/30; F25J 2290/80; F25J 2290/90; F25J 3/0209; F25J 3/0295; F25J 3/02

USPC ..... 422/186.11

See application file for complete search history.

(56) References Cited

U.S. PATENT DOCUMENTS

| | | | | |
|---|---|---|---|---|
| 2,763,985 A | | 9/1956 | Speer | |
| 4,550,561 A | | 11/1985 | Coffinberry | |
| 5,309,778 A | * | 5/1994 | Antonov | B60K 6/26 74/15.86 |
| 6,071,481 A | * | 6/2000 | Mathews | B01D 53/8678 422/170 |
| 8,366,412 B2 | * | 2/2013 | Grethel | F02B 39/04 123/561 |
| 8,496,450 B2 | * | 7/2013 | Mellar | F04B 17/05 417/319 |

(Continued)

FOREIGN PATENT DOCUMENTS

CN 204212950 3/2015

OTHER PUBLICATIONS

The Pneumatic Air System (https://necc-controls.com/pneumatic-accessories/pneumatic-air-system-schematic.html).

(Continued)

*Primary Examiner* — Dominick L Plakkoottam
(74) *Attorney, Agent, or Firm* — Charles Runyan

(57) ABSTRACT

An instrument air system and method is disclosed herein. The instrument air system includes a shaft-driven air compressor configured to generate instrument air by compressing atmospheric air, a power take off configured to derive drive torque from a driven rotary shaft of the process, wherein the power take off may include a concentrically-mounted clamping collar adapted to frictionally engage the driven rotary shaft, a torque-transfer assembly configured to transfer the drive torque derived by the power take off to the shaft-driven air compressor, wherein the torque-transfer assembly comprises a set of interoperating gears including a ring gear operably coupled to the clamping collar, and an instrument-air pathway configured to supply the instrument air generated by the shaft-driven air compressor to the pneumatic process-control subsystem. The instrument air system and method is useful for reducing hydrocarbon emissions of a process using a pneumatic process-control subsystem.

18 Claims, 7 Drawing Sheets

(56) References Cited

U.S. PATENT DOCUMENTS

| | | | | |
|---|---|---|---|---|
| 8,522,521 | B2 | 9/2013 | Dyer | |
| 8,726,629 | B2 | 5/2014 | Coney | |
| 8,973,361 | B2 | 3/2015 | Shimizu et al. | |
| 8,978,400 | B2 | 3/2015 | Dunn et al. | |
| 9,915,192 | B2 * | 3/2018 | Buschur | F02B 33/40 |
| 2008/0078448 | A1 | 4/2008 | Gassman et al. | |
| 2014/0044517 | A1 | 2/2014 | Saha et al. | |
| 2017/0002739 | A1 | 1/2017 | Ramirez et al. | |

OTHER PUBLICATIONS

Pneumatic Air Compressor (http://www.cottonyarnmarket.net/OASMTP/Pneumatic%20Air%20Compressor.pdf).

* cited by examiner

Methane Reduction Revenue

| | |
|---|---|
| Total Annual Revenue | $26,895 |
| Cost of System | $62,350 |

CO2 Equivalent Calculator

| CH4 $ft^3$/min | $m^3$/year | Tonne CH4 | Tonne CO2e | Credit Value | Mcf Gas saved | Gas Value |
|---|---|---|---|---|---|---|
| 3.5 | 49,488 | 52.37 | 1,100 | $13,300 | 2,719 | $13,595 |

Controller maintenances saved per year on average 15 controllers @ $200/year each will save this lease $3000

| | | |
|---|---|---|
| Price of Gas | $5.00 | /mcf |
| Carbon Credit Value | $13.00 | /tonne |

Class 43.1 Accelerated Depreciation

| Write off | | | % per year | |
|---|---|---|---|---|
| 62,350 | 6079 | 56,271 | 25% | 1st year |
| 56,271 | 10,973 | 45,298 | 50% | 2nd year |
| 45,298 | 8,833 | 36,465 | 50% | 3rd year |
| 36,465 | 7,111 | 29,354 | 50% | 4th year |
| | | 29,354 | Remaining cost | |

ANNUAL SAVINGS Include:

| | | |
|---|---|---|
| Gas saved annually | = $13,595 | |
| Carbon Credit value | = $13,300 | |
| Reduced controller maintenances | = $3,000 | |
| Tax savings under current law | = $6,079 | 2nd year $10,973 |
| Total savings in 1st year | $35,974 | |

With all savings added for the first 2 years may amount to $76,842 allowing for a 19.5 month payback at $62,350.

FIG. 7

INSTRUMENT AIR SYSTEM AND METHOD

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of fluid handling systems of existing art and more specifically relates to pneumatic process-control apparatus.

RELATED ART

Natural gas production sites frequently vent gas products as part of the production process. One of the largest sources of hydrocarbon emissions in natural gas production is gas products vented from pneumatic devices, which use a portion of the extracted pressurized gas to open and close valves, operate pumps, and perform similar process-control operations. These devices are designed to release or "bleed" small amounts of gas during their operation. Such equipment is widely used throughout remote natural gas extraction, processing, and transmission processes. Studies of the industry estimate that natural-gas driven pneumatic equipment vents nearly two million metric tons of methane each year. At this scale, the loss of natural gas to such control processes represents a significate cost impact to those operating natural gas production sites. Furthermore, the environmental impact of natural gas leakage and potential regulatory penalties for exceeding limits on levels of emission of natural gas create additional incentives to find new systems and methods to reduce or eliminate these losses.

By way of example, U.S. Pat. Publication. 2008/0078448 to Gassman et al. relates to a low consumption pneumatic controller. The described low consumption pneumatic controller includes a pneumatic controller for controlling a process advantageously reduces fluid consumption by providing a proportional adjustment to a feedback signal. The pneumatic controller comprises a pneumatic control stage, a process pressure detector, and a feedback proportioning device. The feedback proportioning device uses a feedback cantilever component to provide the proportional adjustment of the feedback signal, thereby reducing the fluid consumption of the pneumatic controller.

SUMMARY OF THE INVENTION

In view of the foregoing disadvantages inherent in the known pneumatic process-control apparatus art, the present disclosure provides a novel instrument air system and method. The general purpose of the present disclosure, which will be described subsequently in greater detail, is to provide an instrument air system and method.

In accordance with a preferred embodiment hereof, this system provides an instrument air system relating to the reduction of hydrocarbon emissions of a process using a pneumatic process-control subsystem, the instrument air system including; a shaft-driven air compressor configured to generate instrument air by compressing atmospheric air, a power take off configured to derive drive torque from a driven rotary shaft of the process, wherein the power take off may include a concentrically-mounted clamping collar adapted to frictionally engage the driven rotary shaft, a torque-transfer assembly configured to transfer the drive torque derived by the power take off to the shaft-driven air compressor, wherein the torque-transfer assembly comprises a set of interoperating gears including a ring gear operably coupled to the clamping collar, and an instrument-air pathway configured to supply the instrument air generated by the shaft-driven air compressor to the pneumatic process-control subsystem.

Moreover, it provides such an instrument air system, wherein the instrument-air pathway may further include an air storage tank configured to store the instrument air generated by the shaft-driven air compressor. Additionally, the instrument-air pathway may include an instrument-air dryer configured to remove moisture from the instrument air generated by the shaft-driven air compressor. The interoperating gears of the torque-transfer assembly may be adapted to convert an output shaft speed of the driven rotary shaft to an input shaft speed required to operate the shaft-driven air compressor. In addition, it provides such an instrument air system, further including a support housing configured to supportively house the power take off and the torque-transfer assembly, wherein the support housing may include a rotary-shaft passage adapted to pass the driven rotary shaft through the support housing. The support housing may also include an internal gear chamber configured to contain the set of interoperating gears of the torque-transfer assembly, and the internal gear chamber may contain a volume of lubrication fluid adapted to lubricate the interoperating gears during operation.

Further, a support bracket configured to support the shaft-driven air compressor from the support housing may be provided. Even further, the system may include at least one motion restraint to restrain motion of the support housing induced by torque coupling with the driven rotary shaft. Moreover, it provides such an instrument air system, further including at least one shaft bearing adapted to concentrically engage the driven rotary shaft, wherein the shaft bearing is mounted to the support housing, and wherein the at least one shaft bearing is configured provide reduced-friction positioning of the support housing relative to the driven rotary shaft. Additionally, the shaft bearing may be a split bearing assembly having multiple bearing sections adapted to engage the driven rotary shaft while the driven rotary shaft is operably coupled to the process. Similarly, the support housing may include a first housing section and a second housing section, and the first housing section and the second housing section defining a first line of separation arranged to enable mounting of the support housing around the driven rotary shaft while the driven rotary shaft is operably coupled to the process. The first housing section may include a first a mating surface extending along the first line of separation, the second housing section may include a second mating surface extending along the first line of separation, the support housing may further include a first seal provided between the first a mating surface and the second mating surface, the first seal adapted to form a fluid-tight barrier along the first line of separation when the first housing section is joined with the second housing section, and the first a mating surface and the second mating surface define a separation plane intersecting the rotary-shaft passage.

In addition, the first housing section and the second housing section may each include at least two subsections adapted to divide the first housing section and the second housing section along a second line of separation. The support housing may further include a second seal adapted to form a fluid-tight barrier along the second line of separation when the at least two subsections are joined.

Moreover, it provides such an instrument air system, wherein the set of interoperating gears include toothed gears. Further, it provides such an instrument air system, wherein the instrument-air pathway may further include at least one pneumatic coupler configured to operably couple the instrument air generated shaft-driven air compressor to the pneumatic process-control subsystem.

In addition, it provides such an instrument air system, further including at least one instrument-air pneumatic process-control device adapted to replace at least one existing gas pneumatic process-control device of the pneumatic process-control subsystem. Even further, it provides such an instrument air system, wherein the process may include a petroleum-gas compressor, and the power take off is configured to engage the driven rotary shaft driving a cooling fan of the petroleum-gas compressor. Even further, the system may include a set of instructions, wherein the instrument air system is arranged as a kit.

In accordance with a preferred method hereof, this system provides a method relating to the reduction of hydrocarbon emissions of a process by retrofitting an existing pneumatic process-control subsystem from hydrocarbon gas operation to instrument-air operation, the method including the steps of; providing a source of instrument air, the source including a shaft-driven air compressor configured to generate instrument air by compressing atmospheric air, a power take off configured to derive drive torque from a driven rotary shaft of the process, the power take off including a concentrically-mounted clamping collar adapted to frictionally engage the driven rotary shaft, a torque-transfer assembly configured to transfer the drive torque derived by the power take off to the shaft-driven air compressor, the torque-transfer assembly including a set of interoperating gears including a ring gear mounted to the clamping collar, a support housing configured to supportively house the power take off and the torque-transfer assembly, a support bracket configured to support the shaft-driven air compressor from the support housing, at least one motion restraint to restrain motion of the support housing induced by torque coupling with the driven rotary shaft, at least one shaft bearing adapted to concentrically engage the driven rotary shaft, an air storage tank configured to store a volume of the instrument air generated by the shaft-driven air compressor, an instrument-air dryer configured to remove moisture from the instrument air generated by the shaft-driven air compressor, and an instrument-air pathway configured to supply the instrument air generated shaft-driven air compressor to the pneumatic process-control subsystem, decoupling the existing pneumatic process-control subsystem from an existing hydrocarbon gas source, and operably coupling the existing pneumatic process-control subsystem to the instrument air generated by the source of instrument air. Even further, it provides such a method, further including the steps of offsetting at least a portion of the cost of the retrofitting the petrochemical process by acquiring at least one carbon-credit rebate associated with such retrofitting.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, an instrument air system and method, constructed and operative according to the teachings of the present disclosure.

FIG. 7 is an illustration of an energy savings calculation.

The various embodiments of the present invention will hereinafter be described in conjunction with the appended drawings, wherein like designations denote like elements.

DETAILED DESCRIPTION

As discussed above, embodiments of the present disclosure relate to pneumatic process-control apparatus and more particularly to an instrument air system and method as used to reduce hydrocarbon emissions of a process using a pneumatic process-control subsystem.

Generally, the presently-disclosed system supplies clean dry air to all pneumatic controls on a gas-compressor site. The unit attaches to the shaft driving the cooling fan on a gas compressor. The unit is adapted to increase the shaft rotational speed from about 300 revolutions per minute (RPM) to the required RPM range needed to drive an oil-less air-compressor head at a sufficient cubic-feet-per-minute (CFM) output needed to fill an air storage tank. The compressed air is dried and then used to supply all pneumatic operated controls on site. The unit is designed for remote facilities that have no power on site, but can be used where power is available, as well.

Figure 1:
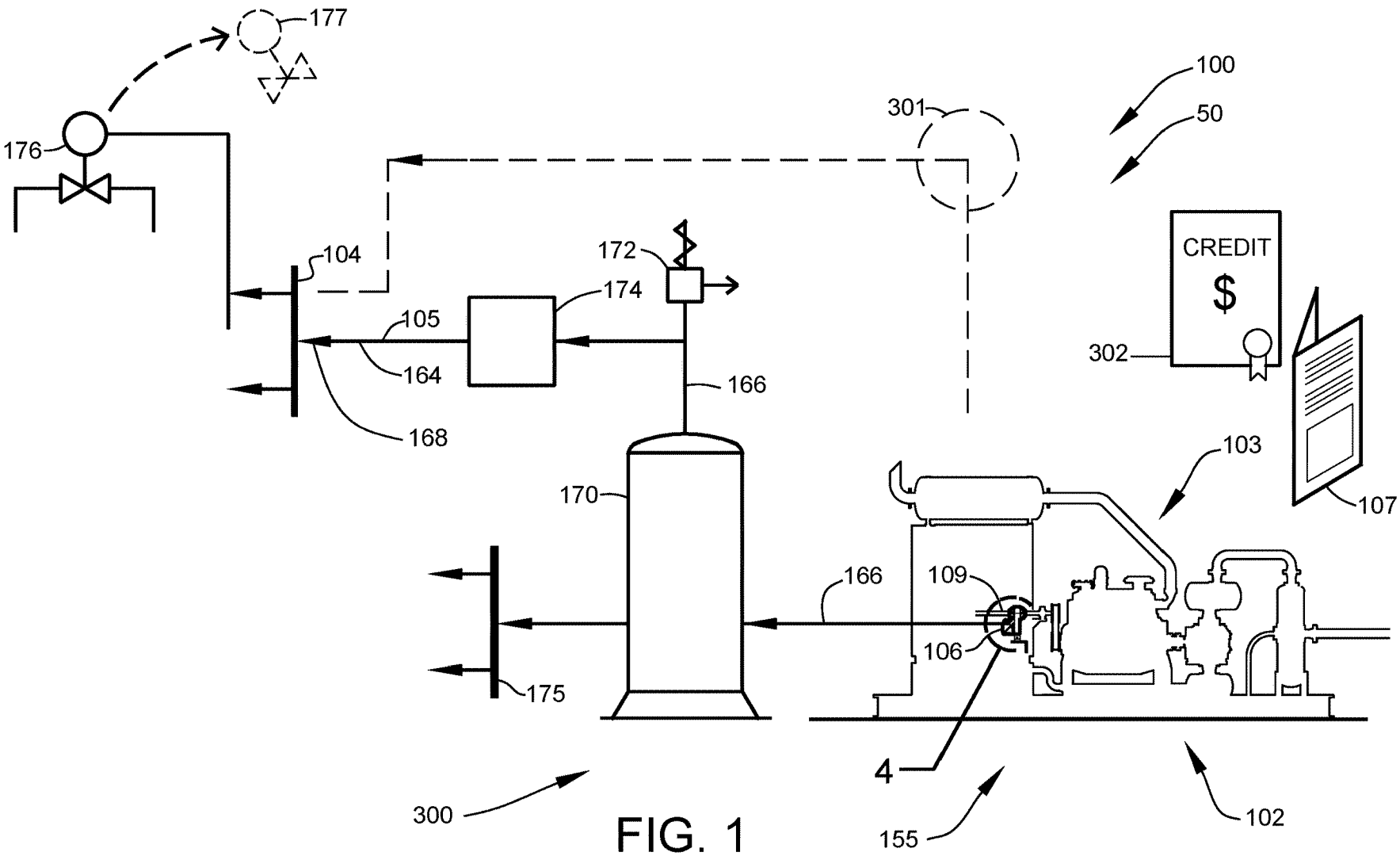
FIG. 1 is a schematic diagram generally illustrating of the instrument air system, during an 'in-use' condition, according to an embodiment of the disclosure.
Figure 2:
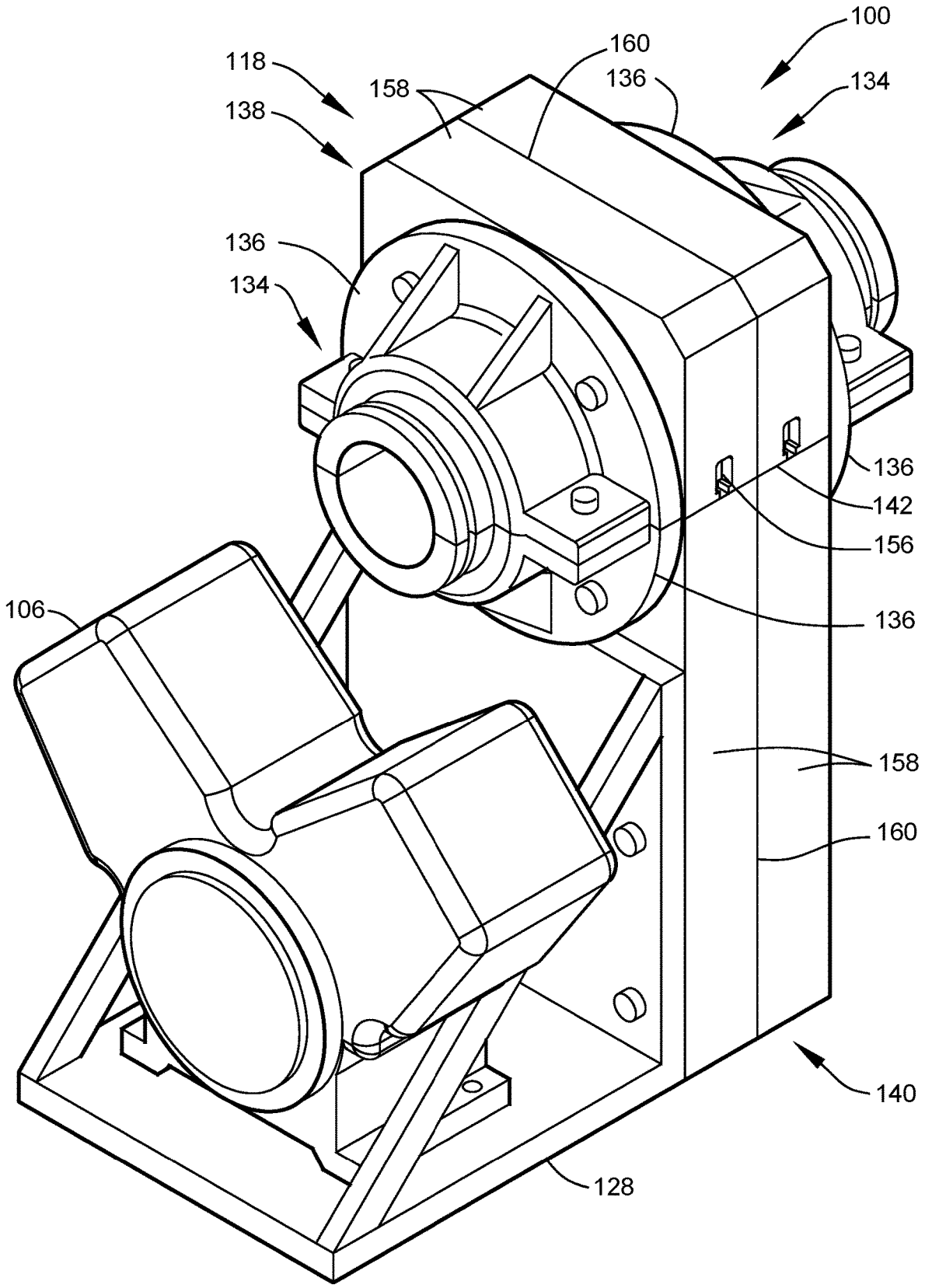
FIG. 2 is a front perspective view of the instrument air system, according to an embodiment of the disclosure.
Figure 3:
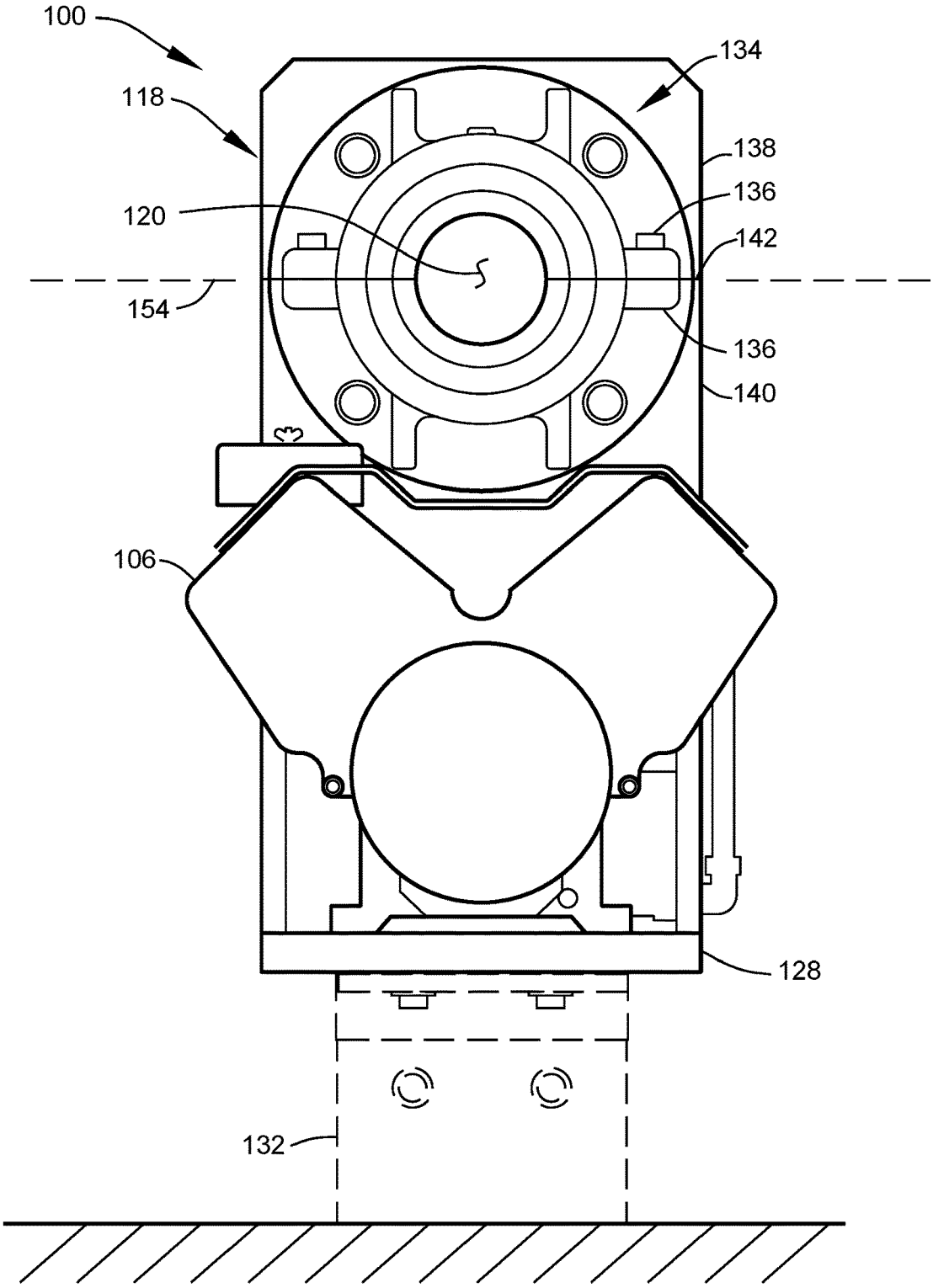
FIG. 3 is a front view of the instrument air system of FIG. 1, according to an embodiment of the present disclosure.
Figure 4:
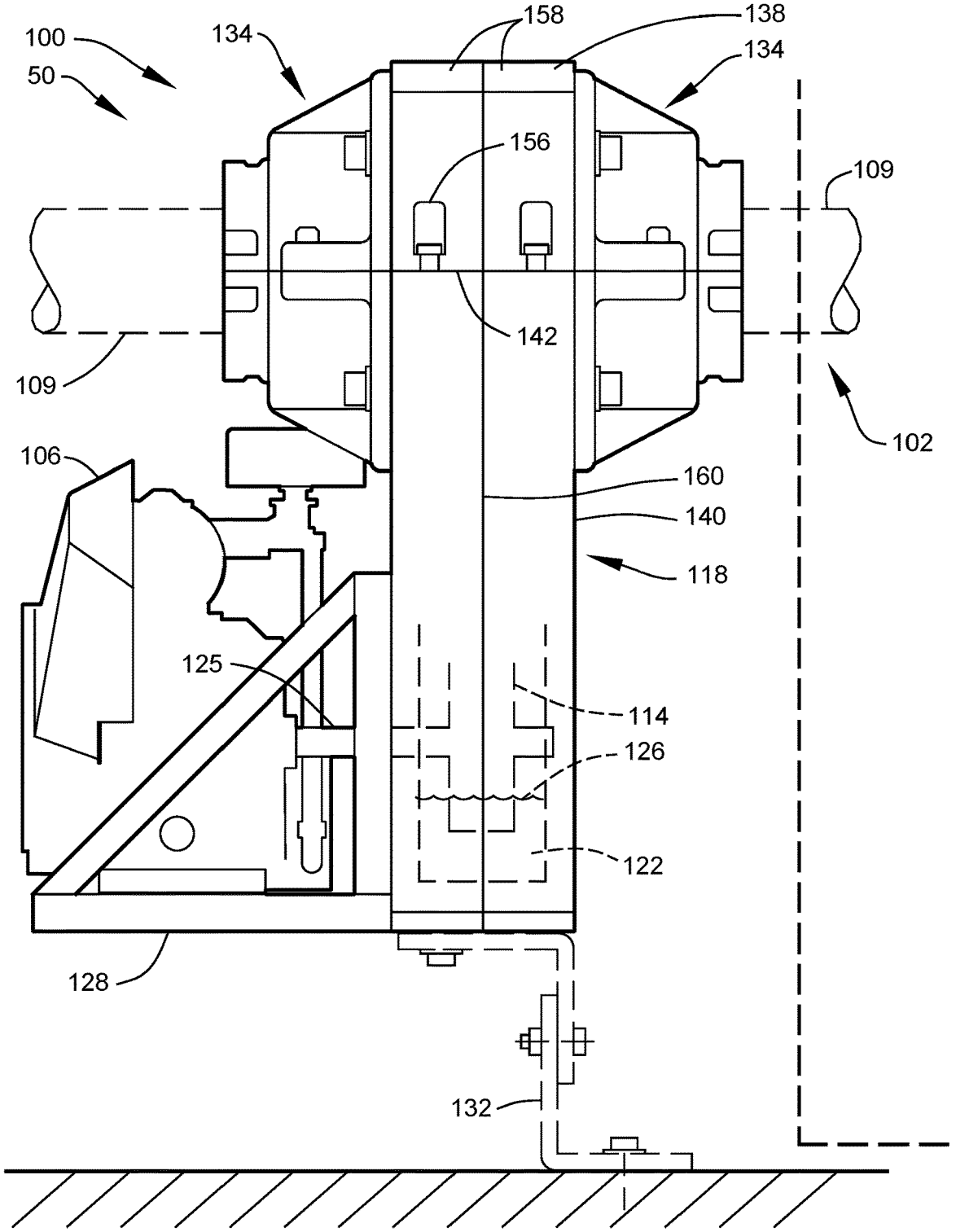
FIG. 4 is a side view of the instrument air system of FIG. 1, during an 'in-use' condition 50, according to an embodiment of the present disclosure.
Figure 5:
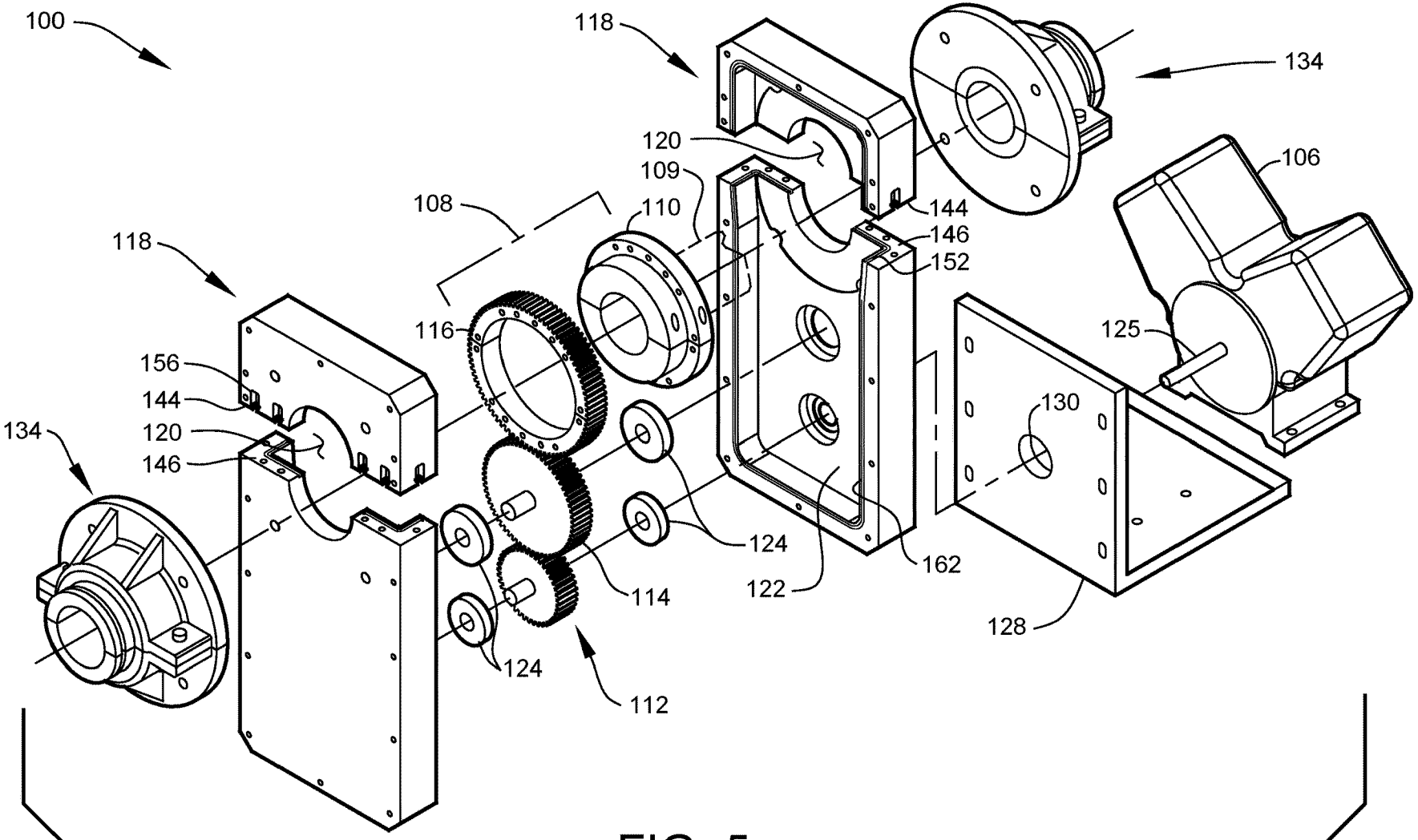
FIG. 5 is an exploded view of the instrument air system of FIG. 1, according to an embodiment of the present disclosure.

Referring now more specifically to the drawings by numerals of reference, there is shown in FIGS. 1-6, various views of an instrument air system 100. FIG. 1 shows a schematic diagram of the instrument air system 100, according to an embodiment of the present disclosure. FIG. 2 is a front perspective view of the instrument air system 100, according to an embodiment of the disclosure. FIG. 3 is a front view of the instrument air system 100 of FIG. 1, according to an embodiment of the present disclosure. FIG. 4 is a side view of the instrument air system 100 of FIG. 1, during an 'in-use' condition 50, according to an embodiment of the present disclosure. FIG. 5 is an exploded view of the instrument air system 100 of FIG. 1, according to an embodiment of the present disclosure. With regard to FIG. 1 through FIG. 5, the instrument air system 100 may be beneficial in reducing hydrocarbon emissions of a process 102 using a pneumatic process-control subsystem 104. It is noted that the present system may be used in the natural gas industry to reduce hydrocarbon emissions associated with venting from pneumatic devices operated by production gases. By way of example, the above-noted process 102 may be a petroleum-gas compressor 103 (such as, a natural-gas compression unit) utilizing the pneumatic process-control subsystem 104. The presently-disclosed instrument air system 100 may be used to convert the pneumatic process-control subsystem 104 from petroleum-gas operation to operation using environmentally-safe instrument air (compressed air).

As illustrated, the instrument air system 100 may include a shaft-driven air compressor 106 configured to generate instrument air 105 by compressing atmospheric air. In the present disclosure, the term "instrument air" shall be applied generally to compressed air generated by the system. It is noted that additional filtering and drying steps may occur before the compressed air is delivered to the pneumatic process-control subsystem 104, as will be described in greater detail below. Shaft-driven air compressors suitable for use in the present system include the OTS series of industrial oil-less reciprocating piston compressors produced by the Powerex Company of Harrison, Ohio USA.

A power take off 108 configured to derive drive torque from a driven rotary shaft 109 of the process 102 is provided. The power take off 108 may include a two-part clamping collar 110 adapted to frictionally engage a driven rotary shaft 109 of the process 102. The clamping collar 110 is concentrically-mounted around the rotary shaft 109 and may be installed without removing the shaft from service.

A torque-transfer assembly 112, configured to transfer the drive torque derived by the power take off 108, is operably coupled to the shaft-driven air compressor 106, as shown. The torque-transfer assembly 112 includes a set of interoperating gears 114 including a ring gear 116 operably coupled to the clamping collar 110 using a threaded fasteners or other bolted connections (omitted from view). The ring gear 116 is also provided as a two-part assembly to allow the ring gear 116 to be installed around the driven rotary shaft 109 without removing the shaft from service.

The interoperating gears 114 of the torque-transfer assembly 112 may include a set of toothed gears, as shown. More specifically, the interoperating gears 114 may consist of three spur-type gears adapted to convert an output shaft speed of the driven rotary shaft 109 to an input shaft speed required to operate the shaft-driven air compressor 106. In some applications of the present system, the torque-transfer assembly 112 may be adapted to convert a 200 RPM rotational shaft speed of the driven rotary shaft 109 to a compressor input shaft speed of between about 620 and about 1250 RPM.

The instrument air system 100 may further include a support housing 118 configured to supportively house the power take off 108 and the torque-transfer assembly 112, as shown. The support housing 118 may include a rotary-shaft passage 120 adapted to pass the driven rotary shaft 109 through the support housing 118, as diagrammatically illustrated in FIG. 4. The support housing 118 may also include an internal gear chamber 122 configured to contain the set of interoperating gears 114 of the torque-transfer assembly 112. The support housing 118 may be arranged to receive a set of gear-shaft bearings 124 adapted to support the rotating support shafts of the interoperating gears 114. In one embodiment of the present system, the internal gear chamber 122 may contain a volume of lubrication fluid 126 adapted to lubricate the interoperating gears 114 during operation (indicated in FIG. 4 by a dashed-line depiction).

An L-shaped support bracket 128 configured to support the shaft-driven air compressor 106 is provided, as shown. The support bracket 128 is adapted for adjustable mounting to the front of the support housing 118 using bolted connections. An aperture 130 is formed in the support bracket 128 to allow the input shaft 125 of the shaft-driven air compressor 106 to pass into internal gear chamber 122 of the support housing 118. It is noted that an intermediate shaft coupler may also be used to join the input shaft 125 and the torque-transfer assembly 112. A set of slotted bolt holes allows the input shaft of the shaft-driven air compressor 106 to be aligned with the interoperating gears 114 of the torque-transfer assembly 112.

In most applications, at least one motion restraint 132 (indicated diagrammatically in FIG. 3 and FIG. 4 by a dashed-line depiction) is provided to restrain the motion of the support housing 118 induced by torque coupling with the driven rotary shaft 109. The motion restraint 132 may be an adjustable bracket extending between the bottom of the housing and at least one fixed element located adjacent to the assembly.

The instrument air system 100 may further include at least one shaft bearing 134 adapted to concentrically engage the driven rotary shaft 109, as shown. In the depicted embodiment, a shaft bearing 134 is mounted to each side of the support housing 118, as shown. The shaft bearing 134 is configured provide reduced-friction positioning of the support housing 118 relative to the driven rotary shaft 109. The shaft bearing 134 may be supplied as a split bearing assembly having multiple bearing sections 136 adapted to engage the driven rotary shaft 109 while the driven rotary shaft 109 is operably coupled to the process 102. The bearings are split down to the shaft so that all components, including the internal seals, can be easily and quickly installed or replaced. Split bearings suitable for use in the present system include flange-type split bearings produced by the Craft Bearing Company of Newport News, Va. USA.

The support housing 118 may include a first housing section 138 and a second housing section 140, as shown. The first housing section 138 and the second housing section 140 define a first line of separation 142 arranged to enable mounting of the support housing 118 around the driven rotary shaft 109 while the driven rotary shaft 109 is operably coupled to the process 102. The first housing section 138 may include a first a mating surface 144 extending along the first line of separation 142. The second housing section 140 may include a second mating surface 146 146 extending along the first line of separation 142. The support housing 118 may further include a first seal 152 provided between the first a mating surface 144 and the second mating surface 146, the first seal 152 is adapted to form a fluid-tight barrier along the first line of separation 142 when the first housing section 138 is joined with the second housing section 140. It is noted that the first a mating surface 144 and the second mating surface 146 define a separation plane 154 intersecting the rotary-shaft passage 120.

In one embodiment, the first housing section 138 contains a set of recessed bolt pockets 156 enabling the first housing section 138 to be joined with the second housing section 140 using bolted connections (it is noted that some mechanical fasteners of the exploded view have been omitted from the view for clarity of description). Alternately, the housing section may be joined using through-bolt fastening.

In addition, the first housing section 138 and the second housing section 140 may each include at least two subsections 158 adapted to divide the first housing section 138 and the second housing section 140 along a second line of separation 160. The second line of separation 160 allows the support housing to be divided in a manner allowing access to the internal gear chamber 122, interoperating gears 114, gear-shaft bearings 124, etc. The subsections 158 may be joined using bolted connections. The second line of separation 160 may further include a second seal 162 adapted to form a fluid-tight barrier along the second line of separation 160 when the at least two subsections are joined. In some embodiment of the present system, the first seal 152 and the second seal 162 may be formed as a single unitary element.

In specific reference to FIG. 1, an instrument-air pathway 164 may also be provided to supply the instrument air 105 generated by the shaft-driven air compressor 106 to the pneumatic process-control subsystem 104. The instrument-air pathway 164 may include transfer piping 166 with at least one pneumatic coupler 168 configured to operably couple the instrument air 105 to the pneumatic process-control subsystem 104.

In one embodiment of the system, the instrument-air pathway 164 may include an air storage tank 170 configured to store the instrument air 105 generated by the shaft-driven air compressor 106. As the shaft-driven air compressor 106 operates continuously along with the driven rotary shaft 109, the instrument-air pathway 164 may include a pressure-relief valve 172 to prevent overpressure of the instrument-air pathway 164 and the pneumatic process-control subsystem 104. Additionally, the instrument-air pathway 164 may include a desiccant instrument-air dryer 174 configured to remove moisture from the instrument air 105 generated by the shaft-driven air compressor 106. Desiccant instrument-air dryers suitable for use in the present system include compressed air filters and dryers produced by SuperDry Systems Inc. of Quebec, Canada.

Thus, during the operation of instrument air system 100, atmospheric air is compressed, stored in the air storage tank 170, is filtered and dried, and is supplied to the pneumatic process-control subsystem 104 for instrument use. It is noted that air may also be supplied for general utility services 175 (e.g., small pneumatic pumps, air tools, etc.). Air for such utility services 175 may be supplied with or without drying, depending on the application.

Upon reading this specification, it should be appreciated that, under appropriate circumstances, considering such issues as user preferences, design preference, control requirements, marketing preferences, cost, available materials, technological advances, etc., other device arrangements such as, for example, the inclusion of pressure-control devices, pressure gauges, sensors, manual and automatic valves, etc., may be sufficient.

In addition, the instrument air system 100 may further including at least one instrument-air pneumatic process-control device 176 adapted to replace at least one existing gas pneumatic process-control device 177 of the pneumatic process-control subsystem. Even further, some embodiment of instrument air system 100 may include the petroleum-gas compressor 103, and the power take off is configured to engage the driven rotary shaft driving a cooling fan of the petroleum-gas compressor 103.

According to one embodiment, the instrument air system 100 may be arranged as a retrofit kit 155. In particular, the instrument air system 100 may further include a set of instructions 107. The instructions 107 may detail functional relationships in relation to the structure of the instrument air system 100 such that the instrument air system 100 can be used, maintained, or the like, in a preferred manner.

Figure 6:
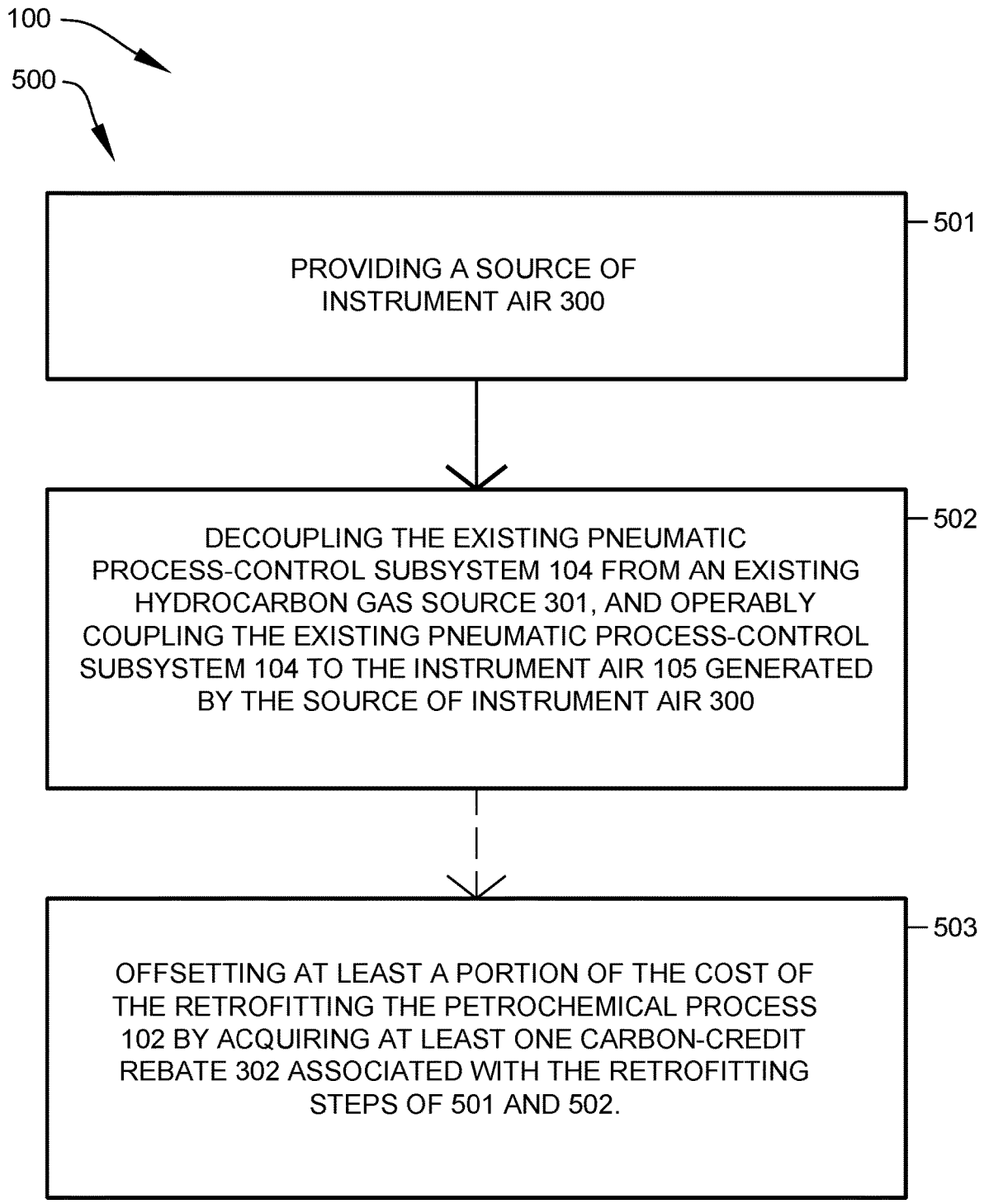
FIG. 6 is a flow diagram illustrating a method of reducing hydrocarbon emissions of a process using a pneumatic process-control subsystem, according to an embodiment of the present disclosure.

FIG. 6 is a flow diagram illustrating a method 500 relating to the reduction of hydrocarbon emissions of a process 102 by retrofitting an existing pneumatic process-control subsystem 104 from hydrocarbon gas operation to instrument-air operation, according to an embodiment of the present disclosure. In particular, the method 500 may include one or more components or features of the instrument air system 100 as described above. As illustrated, the method 500 may include the steps of: step one 501, providing a source of instrument air 300 (see also FIG. 1), the source including; a shaft-driven air compressor configured to generate instrument air by compressing atmospheric air, a power take off configured to derive drive torque from a driven rotary shaft of the process, the power take off including a concentrically-mounted clamping collar adapted to frictionally engage the driven rotary shaft, a torque-transfer assembly configured to transfer the drive torque derived by the power take off to the shaft-driven air compressor, the torque-transfer assembly including a set of interoperating gears including a ring gear mounted to the clamping collar, a support housing configured to supportively house the power take off and the torque-transfer assembly, a support bracket configured to support the shaft-driven air compressor from the support housing, at least one motion restraint to restrain motion of the support housing induced by torque coupling with the driven rotary shaft, at least one shaft bearing adapted to concentrically engage the driven rotary shaft, an air storage tank configured to store a volume of the instrument air generated by the shaft-driven air compressor, an instrument-air dryer configured to remove moisture from the instrument air generated by the shaft-driven air compressor, and an instrument-air pathway configured to supply the instrument air generated shaft-driven air compressor to the pneumatic process-control subsystem; step two 502, decoupling the existing pneumatic process-control subsystem 104 from an existing hydrocarbon gas source 301, and operably coupling the existing pneumatic process-control subsystem 104 to the instrument air 105 generated by the source of instrument air 300 (see FIG. 1).

Method 500 further includes the step 503 of offsetting at least a portion of the cost of the retrofitting the petrochemical process 102 by acquiring at least one carbon-credit rebate 302 associated with the retrofitting steps of 501 and 502. In step 503, a portion of the cost of replacing the natural-gas pneumatic control systems with the disclosed instrument air system may be offset as generally illustrated in Example 1, below.

It should be noted that step 503 is an optional step and may not be implemented in all cases. Optional steps of method 500 are illustrated using dotted lines in FIG. 6 so as to distinguish them from the other steps of method of use 500. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods relating to the reduction of hydrocarbon emissions of a process by retrofitting an existing pneumatic process-control subsystem from hydrocarbon gas operation to instrument-air operation, are taught herein.

Those with ordinary skill in the art will now appreciate that the disclosed system reduces or eliminates the use of hydrocarbon-based gas (i.e., vent gas) to operate the controls of the process. Using the instrument air system 100, as described above, the controls are converted to operate on clean dry air, thus increasing the longevity of the control devices while reducing the required maintenance. Compressor packaging companies may ship new units the instrument air system 100 pre-installed and will also be able to retrofit all existing units in the field using the above method.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. An instrument air system relating to the reduction of hydrocarbon emissions of a process using a pneumatic process-control subsystem, the instrument air system comprising:

a shaft-driven air compressor configured to generate instrument air by compressing atmospheric air;

a power take off configured to derive drive torque from a driven rotary shaft of the process, the power take off including a concentrically-mounted clamping collar adapted to frictionally engage the driven rotary shaft;

a torque-transfer assembly configured to transfer the drive torque derived by the power take off to the shaft-driven air compressor, the torque-transfer assembly comprising a set of interoperating gears including a ring gear operably coupled to the clamping collar; and an instrument-air pathway configured to supply the instrument air generated by the shaft-driven air compressor to the pneumatic process-control subsystem.

2. The instrument air system of claim 1, wherein the instrument-air pathway further comprises an air storage tank configured to store the instrument air generated by the shaft-driven air compressor.

3. The instrument air system of claim 1, wherein the instrument-air pathway further comprises an instrument-air dryer configured to remove moisture from the instrument air generated by the shaft-driven air compressor.

4. The instrument air system of claim 1, wherein the interoperating gears of the torque-transfer assembly are adapted to convert an output shaft speed of the driven rotary shaft to an input shaft speed required to operate the shaft-driven air compressor.

5. The instrument air system of claim 1, further comprising:

a support housing configured to supportively house the power take off and the torque-transfer assembly;

wherein the support housing comprises a rotary-shaft passage adapted to pass the driven rotary shaft through the support housing.

6. The instrument air system of claim 5, wherein the support housing comprises an internal gear chamber configured to contain the set of interoperating gears of the torque-transfer assembly; and the internal gear chamber contains a volume of lubrication fluid adapted to lubricate the interoperating gears during operation.

7. The instrument air system of claim 5, further comprising a support bracket configured to support the shaft-driven air compressor from the support housing.

8. The instrument air system of claim 5, further comprising at least one motion restraint to restrain motion of the support housing induced by torque coupling with the driven rotary shaft.

9. The instrument air system of claim 5, further comprising at least one shaft bearing adapted to concentrically engage the driven rotary shaft;

wherein the at least one shaft bearing is mounted to the support housing; and wherein the at least one shaft bearing is configured provide reduced-friction positioning of the support housing relative to the driven rotary shaft.

10. The instrument air system of claim 9, wherein the shaft bearing comprises a split bearing assembly having multiple bearing sections adapted to engage the driven rotary shaft while the driven rotary shaft is operably coupled to the process; and the support housing comprises a first housing section and a second housing section; and the first housing section and the second housing section define a first line of separation arranged to enable mounting of the support housing around the driven rotary shaft while the driven rotary shaft is operably coupled to the process.

11. The instrument air system of claim 10, wherein the first housing section comprises a first mating surface extending along the first line of separation; the second housing section comprises a second mating surface extending along the first line of separation; the support housing further comprises a first seal provided between the first mating surface and the second mating surface, the first seal adapted to form a fluid-tight barrier along the first line of separation when the first housing section is joined with the second housing section; and the first mating surface and the second mating surface define a separation plane intersecting the rotary-shaft passage.

12. The instrument air system of claim 11, wherein:

the first housing section and the second housing section each comprise at least two subsections adapted to divide the first housing section and the second housing section along a second line of separation; and the support housing further comprises a second seal adapted to form a fluid-tight barrier along the second line of separation when the at least two subsections are joined.

13. The instrument air system of claim 1, wherein the set of interoperating gears comprise toothed gears.

14. The instrument air system of claim 1, wherein the instrument-air pathway further comprises at least one pneumatic coupler configured to operably couple the instrument air generated shaft-driven air compressor to the pneumatic process-control subsystem.

15. The instrument air system of claim 1, further comprising at least one instrument-air pneumatic process-control device adapted to replace at least one existing gas pneumatic process-control device of the pneumatic process-control subsystem.

16. The instrument air system of claim 1, wherein the process comprises a petroleum-gas compressor; and the power take off is configured to engage the driven rotary shaft driving a cooling fan of the petroleum-gas compressor.

17. An instrument air system relating to the reduction of hydrocarbon emissions of a process using a pneumatic process-control subsystem, the instrument air system comprising:

a shaft-driven air compressor configured to generate instrument air by compressing atmospheric air;

a power take off configured to derive drive torque from a driven rotary shaft of the process, the power take off including a concentrically-mounted clamping collar adapted to frictionally engage the driven rotary shaft;

a torque-transfer assembly configured to transfer the drive torque derived by the power take off to the shaft-driven air compressor, the torque-transfer assembly comprising a set of interoperating gears including a ring gear mounted to the clamping collar;

a support housing configured to supportively house the power take off and the torque-transfer assembly;

a support bracket configured to support the shaft-driven air compressor from the support housing;

at least one motion restraint to restrain motion of the support housing induced by torque coupling with the driven rotary shaft;

at least one shaft bearing adapted to concentrically engage the driven rotary shaft;

an air storage tank configured to store a volume of the instrument air generated by the shaft-driven air compressor;

an instrument-air dryer configured to remove moisture from the instrument air generated by the shaft-driven air compressor; and an instrument-air pathway configured to supply the instrument air generated shaft-driven air compressor to the pneumatic process-control subsystem;

wherein the support housing comprises an internal gear chamber configured to contain the set of interoperating gears of the torque-transfer assembly;

the set of interoperating gears comprise toothed gears;

the toothed gears are adapted to convert an output shaft speed of the driven rotary shaft to an input shaft speed required to operate the shaft-driven air compressor;

the support housing comprises a rotary-shaft passage adapted to pass the driven rotary shaft through the support housing;

the internal gear chamber contains a volume of lubrication fluid adapted to lubricate the interoperating gears during operation;

the at least one shaft bearing is mounted to the support housing at the rotary-shaft passage;

the at least one shaft bearing is configured provide reduced-friction positioning of the support housing relative to the driven rotary shaft;

the shaft bearing comprises a split bearing assembly having multiple bearing sections engagable on the driven rotary shaft while the driven rotary shaft is operably coupled to the process;

the support housing comprises a first housing section and a second housing section;

a first line of separation between the first housing section and the second housing section is arranged to enable mounting of the support housing around the driven rotary shaft while the driven rotary shaft is operably coupled to the process; and the power take off is configured to engage the driven rotary shaft driving a cooling fan of a petroleum-gas compressor.

18. The instrument air system of claim 17, further comprising a set of instructions; and wherein the instrument air system is arranged as a kit.

* * * * *